United States Patent [19]

Hopkins

[11] Patent Number: 4,642,526

[45] Date of Patent: Feb. 10, 1987

[54] FLUORESCENT OBJECT RECOGNITION SYSTEM HAVING SELF-MODULATED LIGHT SOURCE

[75] Inventor: F. Kenneth Hopkins, Erlanger, Ky.

[73] Assignee: Angstrom Robotics & Technologies, Inc., Florence, Ky.

[21] Appl. No.: 650,809

[22] Filed: Sep. 14, 1984

[51] Int. Cl.[4] ..... H05B 37/00

[52] U.S. Cl. ..... 315/244; 250/271; 250/504 R; 250/461.1; 315/283

[58] Field of Search ..... 250/271, 361.1, 504; 315/244, 283

[56] References Cited

U.S. PATENT DOCUMENTS

| | | | |
|---|---|---|---|
| 1,671,109 | 5/1928 | George | 315/244 |
| 2,056,629 | 10/1936 | Uyterhoeven et al. | 315/244 |
| 2,562,887 | 8/1951 | Beese | 250/504 |
| 3,059,112 | 10/1962 | Rogal | 250/71 |
| 3,582,623 | 6/1971 | Rothbery | 235/61 |
| 3,650,400 | 3/1972 | Warren et al. | 209/111.5 |
| 3,666,946 | 5/1972 | Trimble | 250/71 |
| 3,781,597 | 12/1973 | Nomura et al. | 315/244 |
| 3,904,872 | 9/1975 | Ebukuro et al. | 250/226 |
| 4,015,333 | 8/1978 | Kaule et al. | 250/365 |
| 4,127,773 | 11/1978 | West | 250/461 |
| 4,399,391 | 9/1983 | Hammer et al. | 315/106 |
| 4,459,516 | 6/1984 | Zelina et al. | 315/244 |

*Primary Examiner*—Harold Dixon
*Attorney, Agent, or Firm*—Frost & Jacobs

[57] ABSTRACT

An object recognition system for detecting visible light of a predetermined wavelength emitted by a fluorescent material illuminated with modulated ultraviolet light produced by a self-modulated high pressure mercury vapor lamp. The lamp forms part of a resonant LC circuit which produces oscillations in the lamp intensity at a frequency higher than line frequency. The resulting visible light is detected, demodulated, and compared with a predetermined threshold to sense when the fluorescent material is present. Self-modulation of the UV lamp source eliminates external triggering, excitation or switching of the lamp power supply.

17 Claims, 1 Drawing Figure

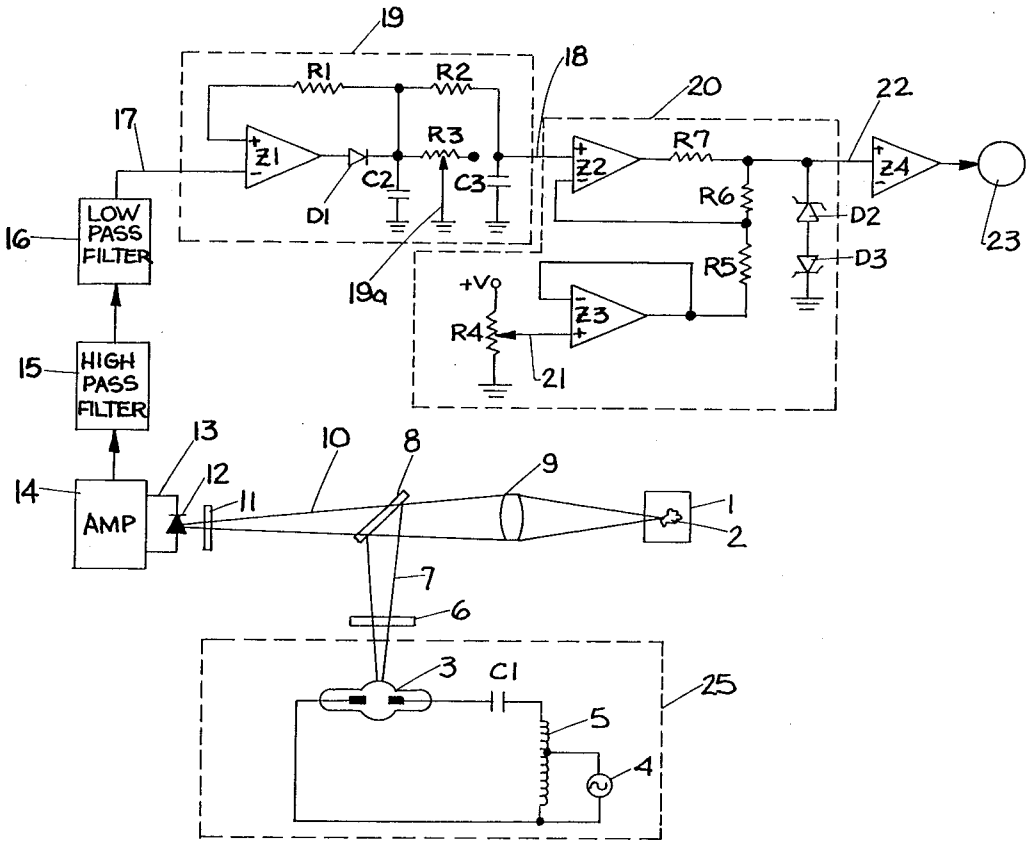
LOW PASS FILTER
HIGH PASS FILTER
AMP
+V
R1
R2
R3
R4
R5
R6
R7
C1
C2
C3
D1
D2
D3
Z1
Z2
Z3
Z4
1
2
3
4
5
6
7
8
9
10
11
12
13
14
15
16
17
18
19
19a
20
21
22
23
25

FLUORESCENT OBJECT RECOGNITION SYSTEM HAVING SELF-MODULATED LIGHT SOURCE

SUMMARY OF THE INVENTION

The present application is directed to a system for detecting ultraviolet fluorescent energy, and more particularly to a system in which the optical light source is self-modulated. It has particular application for object identification or recognition systems where the object is marked with an optically responsive indicia which fluoresces in the visible spectral region upon exposure to ultraviolet light of the proper wavelength.

While various types of optical object identification recognition systems have been proposed, they have not been without their problems. For example, conventional identification systems operating under visible light conditions require a background of contrasting optical character to the indicia placed on the object to assure reliable sensing. Such systems also generally require that the indicia placed on the object be visibly distinguishable from the object upon which it is placed. Often this is accomplished by a sticker or label which is applied to the object which carries with it alternating light and dark areas to provide the necessary contrasting background. Such labels are usually permanently applied to the object, and may not only detract from the object's appearance in the case of a food package, for example, but may also obscure important information. Furthermore, in the case of small objects, it may be physically impossible to apply suitable indicia to the object itself. In many cases the object itself forms part of a larger assembly which requires subsequent removal of the indicia.

Another problem which has been encountered in visible light detection systems is interference from areas or other light sources adjacent the scanned area. For example, erratic operation of the optical detection system may be caused by reflections from the object itself or its carrier, from movement of objects or personnel near the object being scanned, or from visible light sources, particularly those excited by an alternating current power source, such as fluorescent lamps.

The present invention is direction to an object recognition system which overcomes these problems. In the system of the present invention, the object to be identified is marked with a small area of fluorescent material which emits secondary radiation comprising visible light of a predetermined wavelength only when illuminated with ultraviolet radiation in a particular spectral band. Such fluorescent materials have found application, for example, in marking laundry items, and are described in more detail in U.S. Pat. No. 3,066,105, U.S. Pat. No. 3,162,642, and U.S. Pat. No. 3,164,603. These types of fluorescent materials are normally colorless in ordinary light, but fluoresce with a distinctive visible color of a predetermined wavelength when excited by ultraviolet light. Depending on the particular chemical compensation of the material, visible light emission of a large number of spectral bands between yellow and blue may be obtained. Furthermore, by proper formulation, the fluorescent material can be caused to emit visible light in a specific desired wavelength.

In the preferred embodiment of the present invention described herein, ultraviolet radiation is provided by a self-modulated high pressure mercury vapor lamp which is operated from a conventional 60 hertz alternating current power source through a step-up auto transformer in series with a capacitor. As a result of the inherent inductance associated with the auto transformer, a series connected capacitance, and the negative resistance characteristic of the excited high pressure mercury vapor lamp, a resonant circuit is formed which causes the light intensity of the lamp to oscillate at a selectable frequency which is a non-integral multiple of the power line frequency. It will be understood that as used herein, "self-modulated" refers to modulation of the lamp light intensity by means of a resonant circuit including the lamp, rather than by external excitation, triggering or switching of the lamp or its power supply.

For example, in the preferred embodiment described in more detail hereinafter, the light intensity from the lamp has a major Fourier component of 120 hertz which is due to the line voltage and an additional major Fourier modulating frequency component of 1250 hertz. Thus, the lamp is self-modulating at 1250 hertz.

The modulated light output from the vapor lamp passes through an optical absorption filter which passes only a narrow range of ultraviolet energy. The filtered ultraviolet light is reflected from a beam splitter, through a focusing lens and onto the object bearing a small area of fluorescent material. The incident ultraviolet radiation causes the fluorescent material to fluoresce, with the resulting visible light of a predetermined color or wavelength based upon the chemical properties of the fluorescent material being passed back through the lens and beam splitter to an optical band pass interference filter which passes the peak intensity of the visible light.

The filtered visible light is focused onto a photodetector, and the resulting electrical signal from the photodetector filtered so as to remove the line frequency component and thereby isolate the modulating signal. The resulting signal is peak detected, and applied to a voltage comparator which can be set to determine whether or not the system has detected modulated radiation of the proper wavelength from the fluorescent material.

As will become apparent from the detailed description which follows, the oscillating signal produced by the self-modulating lamp provides greater discrimination for the detection system, particularly in applications where high level ambient background light conditions are encountered, since the fluorescing light has a well defined character comprising the modulating component which is not present from the background light sources. That is, the system of the present invention is better able to discriminate between fluctuating UV radiation produced by random or 60 hertz UV sources and a UV source having the proper modulated frequency. In addition, external modulation of the high pressure mercury vapor lamp is not required, so that the modulating signal can be produced by self-modulating the lamp in a manner which is relatively simple, reliable and inexpensive.

Further features of the invention will become apparent from the detailed description which follows.

BRIEF DESCRIPTION OF THE DRAWING

The FIGURE illustrates a schematic diagrammatic view of an object recognition system using the inventive principle of the present invention.

DETAILED DESCRIPTION

For purposes of an exemplary showing, a preferred embodiment of the object recognition system of the present invention is illustrated in the FIGURE It will be observed that the specific application illustrated is for distinguishing the presence or absence of an object 1 bearing a small spot or area 2 of a fluorescent material or coating.

Any fluorescent material which produces visible light of a predetermined wavelength upon being excited by appropriate ultraviolet radiation may be utilized in connection with the present invention, such as those described in U.S. Pat. No. 3,066,105, U.S. Pat. No. 3,162,642, or U.S. Pat. No. 3,164,603. Each of these compositions represents a fluorescent pigment which is normally colorless in ordinary light, but distinctively fluorescent at a particular wavelength when excited by ultraviolet light falling within the appropriate wavelength band. Normally such compounds are supplied in powder form, and are mixed with a plastic or solvent. At very low concentrations, e.g. 0.001%–0.01%, the fluorescent material when applied to the substrate or object 1 is substantially transparent and non-visible. At higher concentrations, depending upon the particular material used, or where the material is mixed with an opaque binder, the material when applied to the underlying object may take on a grey or off-white color. In any event, in many applications it is desirable that the material when applied to the underlying substrate be unnoticeable. Consequently, it may be utilized on objects such as food packages where additional visible markings are undesirable, and in order to avoid obscuration of important information on the package.

The particular chemical composition of the fluorescent material is chosen so that when it is excited by a suitable source of ultraviolet light, the emitted visible light occurs at a specific predetermined wavelength. For purposes of an exemplary showing, one class of compounds particularly useful with the present invention may be summarized by the following chemical formula:

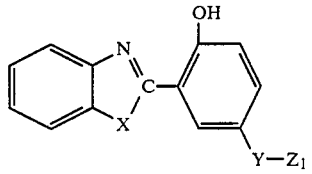

Wherein X represents either oxygen or sulphur, Y represents NHCO and $NHCONZ_2$, and $Z_1$ represents hydrogen, a 1–8 carbon chain aliphatic, and a radical represented by the formula:

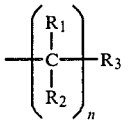

This particular composition produces a colorless compound which floresces yellow to orange in ultraviolet light. Other substitutions of the radicals will produce various other visible output color emissions lying between yellow and blue, i.e. between about 450–620 nm. In any event, by proper choice of the florescent material, the visible light emitted may be accurately determined.

The size of the spot area 2 applied to object 1 will depend upon the particular geometry of the underlying object and the detector installation, as will be described in more detail hereinafter. Furthermore, it will be understood that the spot 2 may be applied to a particular face or side of the underlying object such that the orientation of the object may also be determined. Furthermore, one object 1 may be marked with a material 2 which fluoresces at one visible wavelength, while another object may be provided with a different fluorescent compound fluorescing at a different visible wavelength. In this manner, one object may be distinguished from another. A method and apparatus for accomplishing this is described in more detail in copending patent application Ser. No. 476,477 filed Mar. 18, 1983 and entitled "Object Recognition And Identification System Using Ultraviolet Fluorescent Materials", and assigned to a common assignee. The disclosure of this application is specifically incorporated herein by reference.

The fluorescent material 2 may be excited by means of a light source producing ultraviolet energy within the appropriate spectral band. For purposes of an exemplary showing in the present invention, a high pressure mercury vapor lamp 3 is utilized, which may be of type L5375 manufactured by Canrad-Hanovia. It will be understood that various details of the mounting of lamp 3 have been omitted from the figure for clarity.

Vapor lamp 3 is excited from a 120 volt 60 hertz source of alternating current 4 through a 120/240 volt step-up autotransformer 5 such as a triad type N250MG in series with a 7.5 microfarad capacitor, C1. That is, the primary winding of the autotransformer is connected to the 60 hertz alternating voltage source, while the secondary winding of the autotransformer is connected in series with lamp 3 and capacitor C1.

It will be observed that the inductance inherent in autotransformer 5, together with capacitor C1 form a resonant LC circuit. Furthermore, it is believed that when operating, high pressure mercury vapor lamp 3 exhibits a negative resistance, which in combination with the aforementioned resonant circuit produces oscillations in the intensity of the lamp output so that lamp 3 is continuously modulated at the predetermined modulating frequency. Utilizing the specific components described, it has been found that the light intensity from lamp 3 has a major Fourier component at an even multiple of the supply line frequency, i.e. 120 hertz which is attributable to the second hormonic of the line voltage from voltage source 4, and a modulating additional major Fourier component at a non-integral multiple of the supply line frequency, i.e. 1250 hertz which is attributable to the self-modulation of lamp 3. Consequently, the excitation circuit utilized in connection with high pressure mercury vapor lamp 3 produces self-modulation of the lamp at a particular frequency without the necessity for external modulation of the lamp. It will be understood that the modulating frequency of the lamp may be changed by proper selection of the values for capacitor C1 and the inductance associated with autotransformer 5. It will also be understood that other types of resonant circuits may be employed to self-modulate lamp 3. In any event, it is deemed desirable that the modulating frequency be sufficiently greater than the light intensity oscillation component attributable to the line frequency (or spurious variations in background light intensity) that the higher frequency modulating signal component can be removed by electronic filtering. It will be observed that this condition is satisfied in the present invention inasmuch as the modulating frequency is more than twenty times the 60 hertz supply line frequency.

Returning to the FIGURE, the modulated light output from lamp 3 is passed through an optical absorption filter 6 which only passes a narrow band of ultraviolet radiation, for example at a wavelength of 365 nm. It will be understood that other ultraviolet wavelengths may be utilized depending on the particular type of fluorescent material 2 used, or alternately other types of self-modulated lamps may be used producing different spectral outputs. In any event, the wavelength of the resulting UV radiation will be chosen to be compatible with the particular fluorescent material used.

The resulting filtered UV light 7 is reflected from the reflecting surface of a UV cut-off filter (e.g. a Rolyn 66.2425 filter) used as a beam splitter 8 through a convex focusing lens 9 onto the fluorescent material 2.

The exciting UV energy focused on fluorescent material 2 causes the production of visible light at a predetermined wavelength which is focused through convex lens 9 onto beam splitter 8. The visible light passes through beam splitter 8 as at 10 and passes through an optical band pass interference filter 11 having a narrow passband at the fluorescent visible wavelength of fluorescent material 2.

The output from optical bandpass interference filter 11 is focused onto a photovoltaic detector 12 having a spectral response in the visible fluorescent wavelength region of fluorescent material 2. Consequently, by proper selection of the passband of optical filter 11 and of photovoltaic detector 12, the system is sensitive only to a very narrow range of visible light wavelengths. Consequently, the system will not respond to visible light having wavelengths outside this response band. Furthermore, since the fluorescent material 2 may be caused to fluoresce only when irradiated by suitable ultraviolet light having a predetermined wavelength band, the marking means themselves are relatively insensitive to ambient conditions. In addition, the intensity of the fluorescing material also provides good contrast to the background created by object 1 or other nearby objects. More importantly, however, the signal output on line 13 from photovoltaic detector 12 will have the same major Fourier components as the modulated light output from lamp 3 inasmuch as the relaxation time of the fluorescent material 2 is relatively short compared to the frequencies of the modulating components of the light. Consequently, the electrical output from photovoltaic detector 12 will also be modulated at a frequency of 120 hertz corresponding to the line frequency and a higher modulating frequency such as 1250 hertz associated with the self-modulating characteristic of lamp 3 as previously described.

The remaining portion of the circuitry illustrated in the FIGURE is operable to demodulate the electric output from the photovoltaic detector. In the preferred embodiment, the output from detector 12 appearing on line 13 is buffered by a suitable amplifier 14 and applied to a high pass electrical filter 15 which essentially eliminates the 120 hertz modulating component, while passing the higher frequency modulating component.

The resulting electrical signal from the highpass filter is then applied to a low pass electrical filter 16 which has a cut-off frequency somewhat higher than the high frequency modulating component frequency in order to eliminate noise. For example, in the preferred embodiment described, the cut-off frequency of low pass filter 16 will be at least 1250 hertz. Furthermore, it will be understood that high pass filter 15 and low pass filter 16 may be replaced by a band pass filter having a pass band chosen so as to be centered about the high frequency modulating component (e.g. 1250 hertz) in order to eliminate the 60 and 120 hertz low frequency components as well as high frequency noise.

The output from low pass filter 16 is applied on line 17 to the inverting input of an operational amplifier Z1. The output of operational amplifier Z1 is connected to the anode of a diode D1. The cathode of diode D1 is connected through a resistor R1 to the non-inverting input of Z1, to one terminal of a resistor R2, and to one terminal of a capacitor C2, while the remaining terminal of resistor R2 is connected to one terminal of a capacitor C3, which also forms the output line 18 for this portion of the circuit. The remaining terminal of capacitor C3 is connected to ground. A variable resistor R3 is connected to the junction of diode D1 and capacitor C2, and has its wiper **19*a*** connected to ground.

It will be observed that together these components form a peak detector 19 which operates to produce an output signal on line 18 corresponding to the demodulated peak amplitude of the high frequency modulating component of the modulated visible light received by photovoltaic detector 12. It will be understood that the setting of variable resistor R3 will determine the time constant of capacitor/resistor combination C2/R3, and hence the decay time of the peak detector 19.

The output 18 of peak detector 19 is connected to a voltage comparator or Schmitt trigger 20 formed by operational amplifiers Z2 and Z3. Operational amplifier Z3 is connected as a voltage follower and has its non-inverting input connected to the wiper 21 of a variable resistor R4. Variable resistor R4 is referenced between ground and a positive voltage +V.

The output from voltage reference amplifier Z3 is connected through a resistor R5 to the inverting input of amplifier Z2, and also through resistors R6 and R7 to the output of amplifier Z2. The junction of resistors R6 and R7 form the output from voltage comparator 20, while the output 18 previously described from peak detector 19 is connected to the non-inverting input of amplifier Z2. Voltage swings on the output line 22 of voltage comparator 20 are limited by means of serially connected zener diodes D2 and D3.

The threshold level of voltage comparator 20 is determined by the setting of variable resistor R4. When the positive voltage on peak detector output line 18 exceeds this reference voltage, the output 22 of voltage comparator 20 changes state. It will be observed that the feedback for amplifier Z2 associated with resistor R6 provides hysteresis to the voltage comparison circuit.

The output 22 from comparison circuit 20 is applied to a buffer amplifier Z4 which drives a utilization device, designated generally at 23. For example, utilization device 23 may be a visual or audible indicator, a counter, or any other electrical, mechanical or electromechanical device responsive to a control signal from an object recognition system as is well known in the art.

In operation, when an object bearing the requisite marking indicia 2 is not present, the output from voltage comparator 20 is a low level, and utilization device 23 remains inactivated. However, when an object bearing a fluorescent material 2 having the proper characteristics enters the field of view of the optical scanning portion of the present system, visible light is received by photovoltaic detector 12, which contains the above described high frequency and low frequency modulating components. The low frequency modulating components are removed by filters 15 and 16, and the high frequency modulating component demodulated by the combination of the filters and peak detector 19. If the visible light output produced by fluorescing material 2 is of sufficient intensity so that the voltage on line 18 exceeds the voltage threshold determined by variable resistor R4, the output from voltage comparator 20 on line 22 will assume a high level, thus activating utilization device 23.

It will be understood that various changes may be made in the details, materials, steps and arrangements of parts, which have been herein described and illustrated in order to explain the nature of the invention within the scope and principle as expressed in the appended claims. For example, the self-modulating lamp circuit 25 may be utilized alone in applications where a modulated vapor lamp output is desired. Furthermore, it will be understood that the resonant circuit associated with lamp 3 for producing self-modulation of the lamp may be replaced by other types of resonant circuits capable of producing oscillations in the lamp intensity output of the desired frequency.

The embodiments of the invention in which an exclusive property or privilege is claimed are as follows:

1. A circuit for producing self-modulation of the light intensity of a mercury vapor lamp comprising:

a transformer having primary and secondary windings;

a source of low frequency alternating voltage connected to said primary winding; and a self-resonant circuit comprising the series connection of a copacitor and a mercury vapor lamp connected to said secondary winding, said resonant circuit having a resonant frequency higher than and a non-integral multiple of the frequency of said voltage source, wherein the light intensity of said lamp is caused to oscillate at the resonant frequency of said resonant circuit.

2. The apparatus according to claim 1 wherein said transformer comprises an autotransformer.

3. The apparatus according to claim 1 wherein said lamp produces UV radiation modulated at said frequency of oscillation, said lamp forming part of an object recognition system for detecting objects marked with a UV flourescent material, said object recognition system further including:

means for detecting the presence of modulated secondary radiation emitted by the fluorescing material in the presence of said modulated UV radiation, said detecting means producing a modulated electrical signal in response to said modulated UV radiation; and means for demodulating said modulated electrical signal to produce a second electrical signal upon the detection of said modulated UV radiation.

4. The apparatus according to claim 3 wherein said circuit comprises a LC resonant circuit.

5. The apparatus according to claim 3 wherein said transformer comprises an autotransformer.

6. The apparatus according to claim 3 wherein the frequency of oscillation of the light intensity is at least about twenty times the frequency of said voltage source.

7. The apparatus according to claim 3 wherein the wavelength of said secondary radiation lies within the visible spectrum.

8. The apparatus according to claim 7 wherein said detecting means comprises means responsive only to a narrow band of predetermined wavelengths within said visible spectrum.

9. The apparatus according to claim 3 including optical means for limiting the wavelength band of said UV radiation, beam splitter means for reflecting said limited band UV radiation onto the fluorescent material, and for passing secondary radiation emitted by said fluorescing material, an optical filter means positioned between said detector means and said beam splitter means for limiting the wavelength band of said secondary radiation.

10. The apparatus according to claim 3 wherein said demodulating means comprises filter means for passing only said modulating frequency, peak detector means for producing a third electrical signal corresponding to the intensity of said modulated UV radiation, and comparison means for producing said second electrical signal when said third electrical signal exceeds a predetermined level.

11. A circuit for producing self-modulation of the light intensity of a lamp of the type having a negative resistance characteristic comprising:

a source of low frequency voltage, and self-resonant circuit means including a lamp having a negative voltage characteristic connected to said voltage source for causing the light intensity of the lamp to oscillate at a frequency which is higher than and a non-integral multiple of the frequency of said alternating voltage source.

12. The apparatus according to claim 11 wherein said lamp comprises a mercury vapor lamp.

13. The apparatus according to claim 11 wherein said resonant circuit means comprises a resonant LC circuit.

14. The apparatus according to claim 13 wherein said LC circuit comprises a transformer having a primary winding connected to said voltage source and a secondary winding, and a capacitor connected between said secondary winding and said lamp.

15. The apparatus according to claim 14 wherein said transformer comprises an autotransformer.

16. The apparatus according to claim 11 wherein the frequency of oscillation of said lamp intensity is at least about twenty times the frequency of said voltage source.

17. The apparatus according to claim 11 wherein said resonant circuit means produces modulation of the light intensity of said lamp with a first Fourier component which is an even multiple of the frequency of said voltage source and a second Fourier component which is a non-integral multiple of the frequency of said voltage source.

* * * * *